US006216997B1

(12) United States Patent
Short

(10) Patent No.: US 6,216,997 B1
(45) Date of Patent: Apr. 17, 2001

(54) TREE STAND

(75) Inventor: David Short, Kingston (CA)

(73) Assignee: Northwave Designworks (CA)

( * ) Notice: Subject to any disclaimer, the term of this patent is extended or adjusted under 35 U.S.C. 154(b) by 0 days.

(21) Appl. No.: 09/251,936

(22) Filed: Feb. 18, 1999

(51) Int. Cl.[7] ..... F16N 13/00

(52) U.S. Cl. ..... 248/523; 248/188.3; 248/216.1; 47/43

(58) Field of Search ..... 248/519, 523, 248/188.7, 18.3, 188.4, 216.1; 47/40.5, 42, 43

(56) References Cited

U.S. PATENT DOCUMENTS

| | | | | |
|---|---|---|---|---|
| 4,076,205 | | 2/1978 | Almer et al. | 248/524 |
| 4,310,989 | | 1/1982 | Shannon, Jr. | 47/40.5 |
| 4,569,151 | | 2/1986 | Hoffbeck | 47/40.5 |
| 4,610,356 | * | 9/1986 | Porter et al. | 248/523 |
| 4,936,538 | | 6/1990 | Royce | 248/524 |
| 5,014,461 | | 5/1991 | vom Braucke et al. | 47/40.5 |
| 5,048,230 | | 9/1991 | Bernardy | 47/40.5 |
| 5,090,655 | | 2/1992 | Bisson | 248/523 |
| 5,362,024 | | 11/1994 | Grinnen | 248/524 |
| 5,467,959 | * | 11/1995 | Behringer | 248/523 |
| 5,490,350 | | 2/1996 | Eisenschenk et al. | 47/40.5 |
| 5,492,302 | | 2/1996 | Odom, Jr. | 248/524 |
| 5,685,518 | * | 11/1997 | Fox et al. | 248/523 |
| 5,797,580 | * | 8/1998 | Ryberg | 248/523 |
| 5,870,858 | * | 2/1999 | Manual | 248/519 |
| 6,009,815 | * | 1/2000 | Hartman | 248/188.3 |

* cited by examiner

*Primary Examiner*—Leslie A. Braun
*Assistant Examiner*—Walter Landry
(74) *Attorney, Agent, or Firm*—Katten Muchin Zavis

(57) ABSTRACT

A Christmas tree stand comprises a base and a clamping mechanism which has a pair of opposed jaws with generally v-shaped clamping faces and the jaws being disposed to clamp a tree at circumferentially and longitudinally spaced locations and means for moving the jaws towards and away from each other to clamp and release the tree.

12 Claims, 5 Drawing Sheets

TREE STAND

FIELD OF THE INVENTION

This invention is concerned with tree stands and, in particular, with a stand for holding a Christmas tree.

BACKGROUND OF THE INVENTION

Tree stands currently on the market cover a wide range in costs, complexity and functionality. It is believed that all stands currently available fail in the fundamental requirement of reliably keeping the tree upright over a few weeks time. The fact that new variants enter the market and others disappear every year would seem to indicate that the marketplace, as a whole, shares this dissatisfaction. A good steady tree stand at a reasonable cost is somewhat of an elusive quest.

The failure of existing tree stands stems from the approach that designers have taken in their development. A common design on the Canadian market has, as its base, a small pot to serve as a water reservoir for the tree. Annular thumb screws near the top of the pot secure the tree in place. No additional secure thumb screws can be used near the bottom of the pot because, of course, the water would leak out.

To secure the tree at the bottom of the pot there may be an upward pointing spike or an oversized disk screwed to the base of the tree to prevent sideways motion. The leg arrangement may be three or four discrete legs extending out from the pot or a complete circular base of about sixteen inches in diameter.

These designs prove unreliable. It is not a problem of the stability of the base. Theoretically, a sixteen inch diameter base is adequate to prevent tipping. Furthermore, it can be shown that the base need not be heavily weighted to provide sufficient stability. Yet trees and stands of this design fall over just the same. The source of the problem can be traced to the clamping mechanism to securing the tree which is inadequate in firmly locking the tree to the base.

The clamping inadequacies arise from the thumb screw arrangement which is ill-suited to tree trunk shapes that may be quite uncircular and which behave plastically over time. The larger the tree, the less circumferential area the thumb screws cover proportionately, leading to loss of clamping effect. Spikes protruding from the bottom of the pot are often too short or too dull to dig into the trunk sufficiently to prevent sideway motion. The reservoir itself, which is a structural element of the stand, is often under designed, flexing and deforming upon the sideways loads imparted by the tree through the thumb screws.

Simply put, designers have approached the problem in reverse. Instead of starting with the essential design requirement of making the tree stand, they have started with the secondary requirement of providing a pot of water to the tree and then locate a clamping arrangement within the pot.

The present invention seeks to provide a strong clamping mechanism and a stable stand.

SUMMARY OF THE INVENTION

According to this invention, the tree stand comprises a base, a clamping mechanism comprising a pair of opposed jaws, each having inclined clamping faces to clamp a tree at circumferentially and longitudinally spaced locations and means for moving the jaws towards and away from each other to clamp and release the tree.

Preferably, each jaw comprises two pairs of clamping faces.

Preferably, the clamping faces of opposed pairs are longitudinally spaced apart.

DETAILED DESCRIPTION OF THE PREFERRED EMBODIMENT

Figure 1:
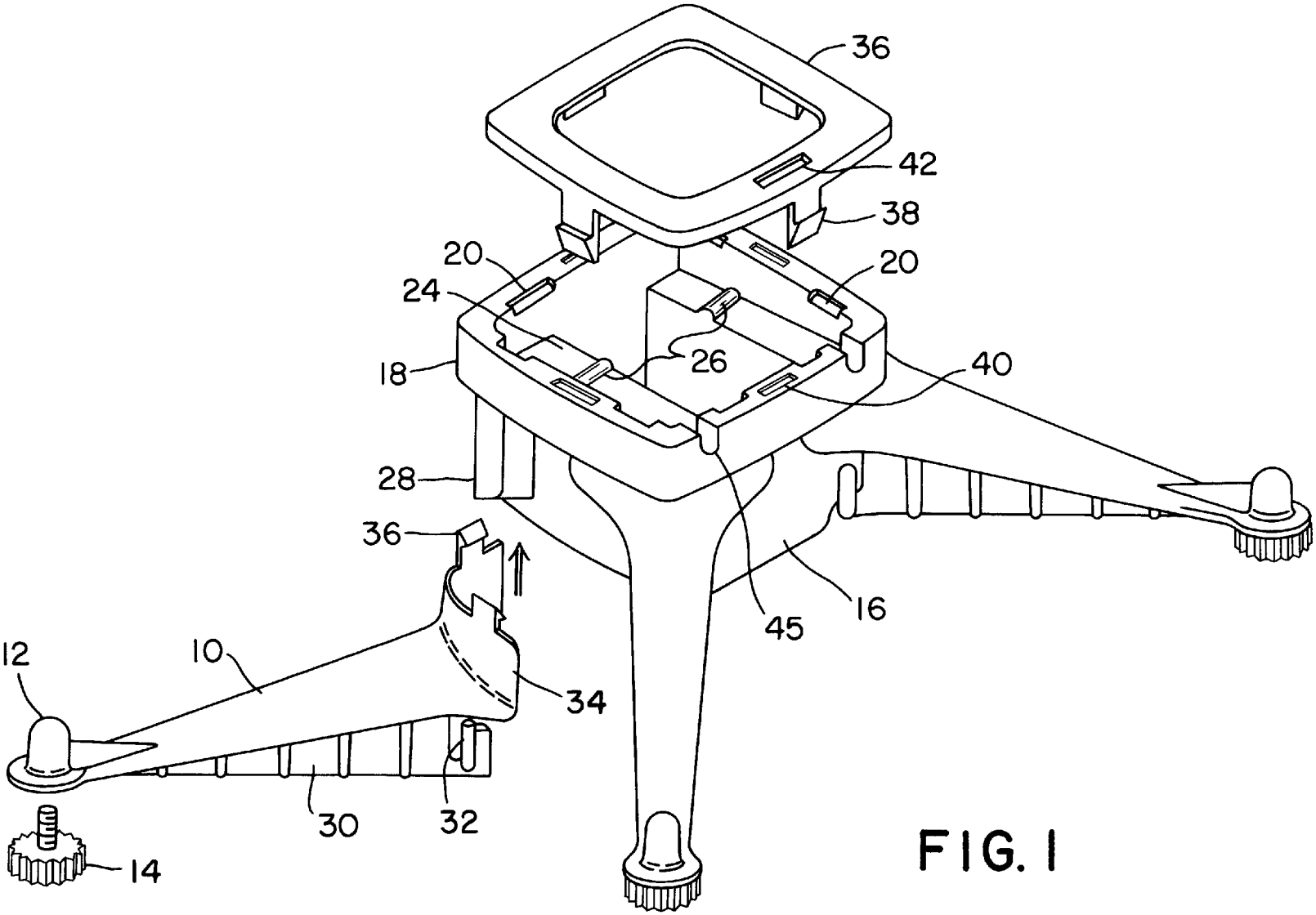
FIG. 1 shows a perspective, partly exploded view of the stand according to this invention.

The stand comprises a base made up of four equiangularly spaced legs 10 which have bosses 12 into which nuts (not shown) are pressed at the lower or distal ends. Each nut receives a screw threaded adjustment bolt 14 which, as will become apparent, permit levelling of the assembly.

An injection molded water reservoir 16 is generally of square section having a peripheral flange 18 at its upper edge which, together with the adjacent portions of the outer surface of the reservoir, define a channel. Two slots 20 adjacent each of the four corners of the reservoir communicate with the channel. Integrally projecting shoulders 24 having stops 26 are molded on opposed interior walls of the reservoir to support the clamping mechanism in the manner described hereinafter.

An upright protrusion 28 is provided on the outer surface of the reservoir at each corner and it is slotted to receive a leg post as described hereinafter.

Each leg has a curved upper surface and a reinforcing rib 30 extending the length of the leg and projecting from the underside of the leg. The rib terminates in a leg post 32.

A flange 34 is formed at the upper or proximal end of the leg and is shaped to conform to the corner portion of the reservoir. A pair of barbed latches 36 project from the upper edge of the flange and are located to register with the slots 20 of the reservoir.

Each leg is assembled to the reservoir by passing the flange 34 of the leg into the peripheral channel so that the latches snapped into the slot 20 and the leg post 32 enters into the slotted protrusions 28. With all four legs assembled, the reservoir and legs constitute a very stable base.

Figure 3:
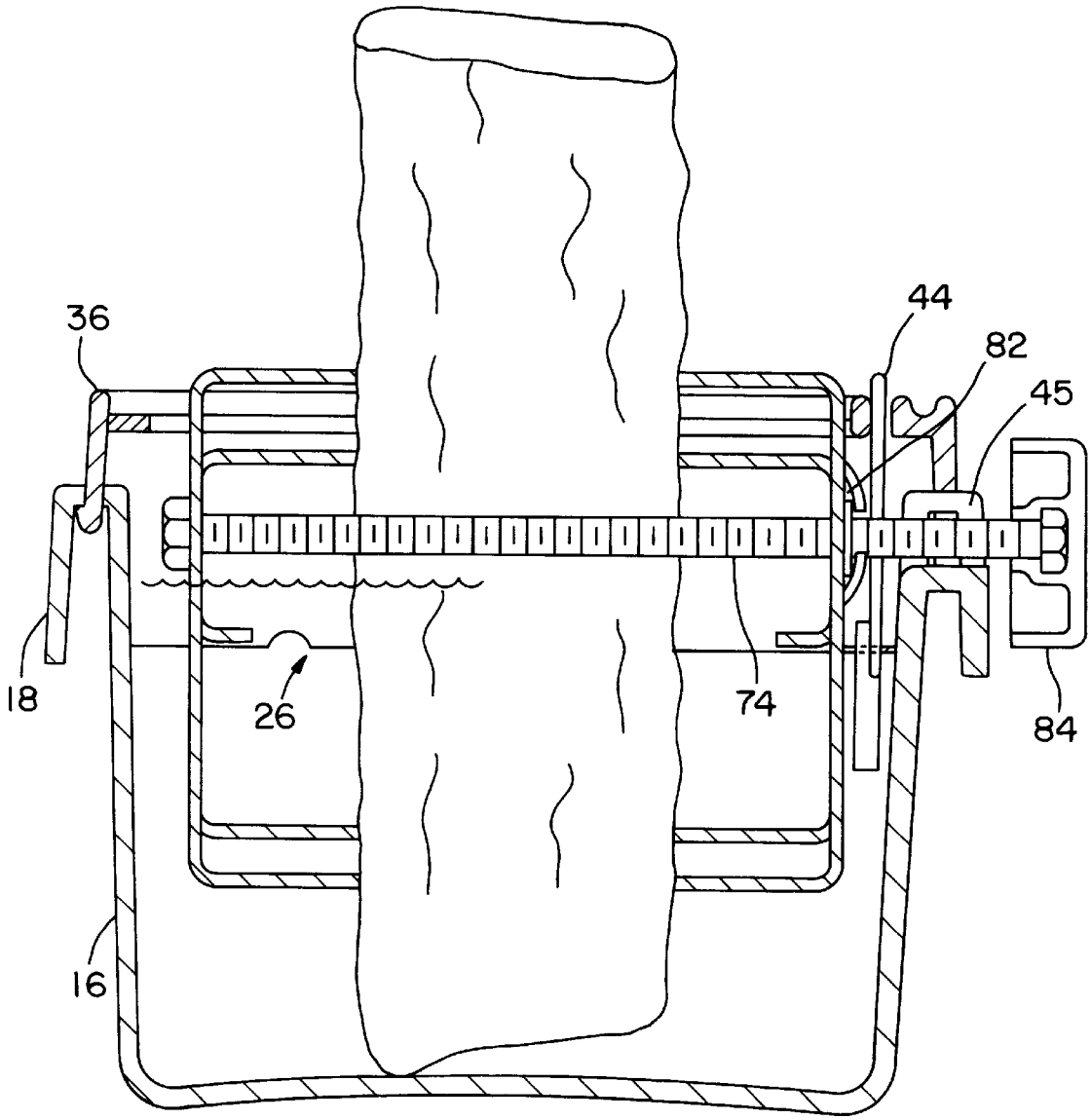
FIG. 3 is a vertical, central section of the stand.
Figure 4:
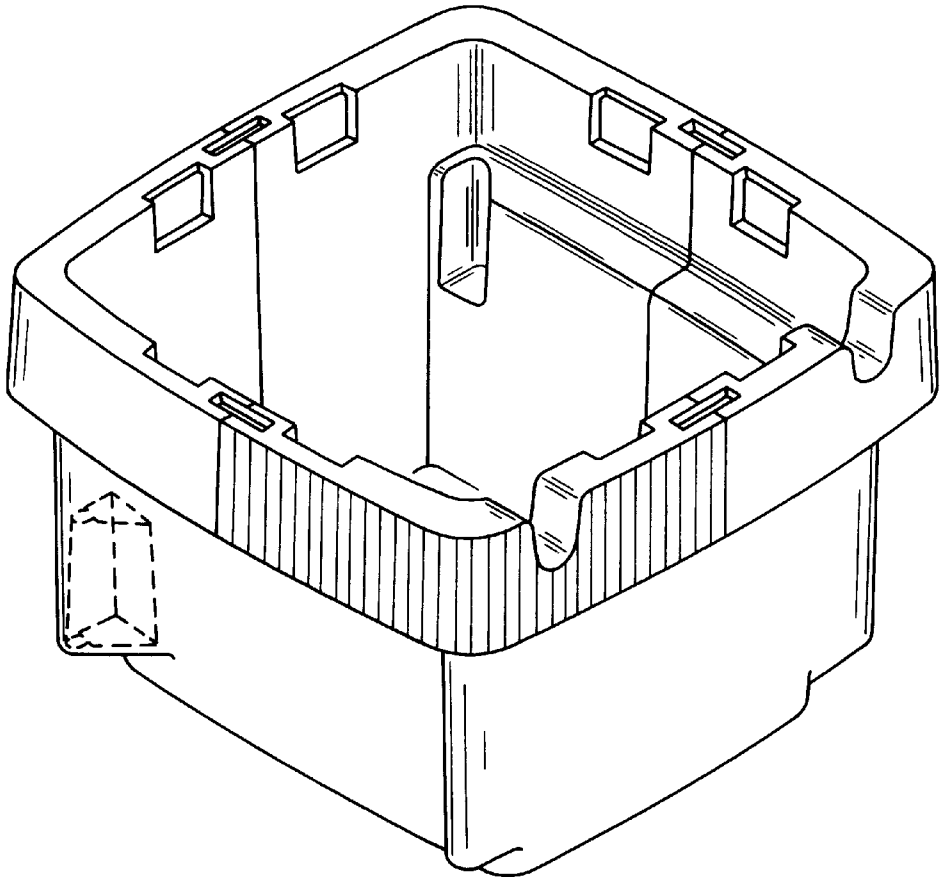
FIG. 4 is a perspective view of the water container of the stand.
Figure 6:
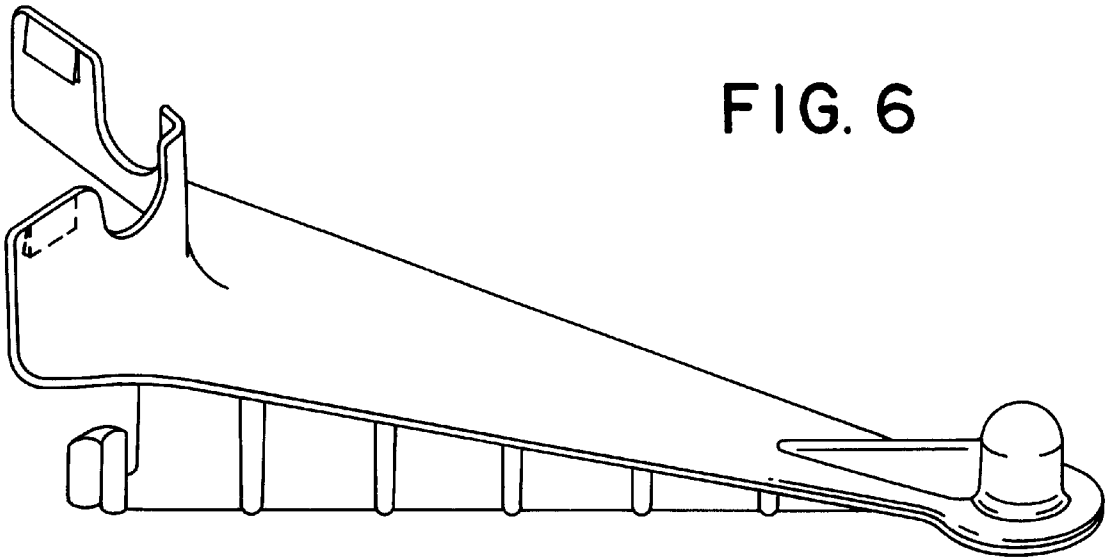
FIGS. 5 and 6 are perspective views of one of the legs of the stand.
Figure 5:
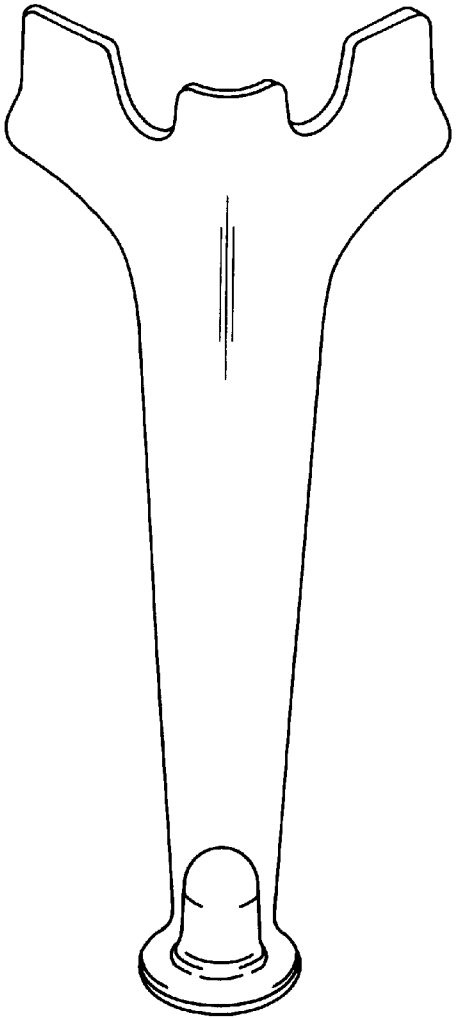

The base is completed by a retaining cover 36 which has four depending latches 38, one disposed centrally of each edge of the cover. The latches are engaged in matching slots 40 formed in the uppermost surface of the reservoir. A slot 42 is formed through the cover to receive a water level indicator 44 as seen in FIG. 3. The indicator comprises a simple float with an index to show the maximum level of water.

Finally, for a purpose which will become apparent, a pair of recesses 45 are formed in the upper edge of one side of the reservoir. As will be described later, they provide access for parts of the clamping mechanism.

Figure 2:
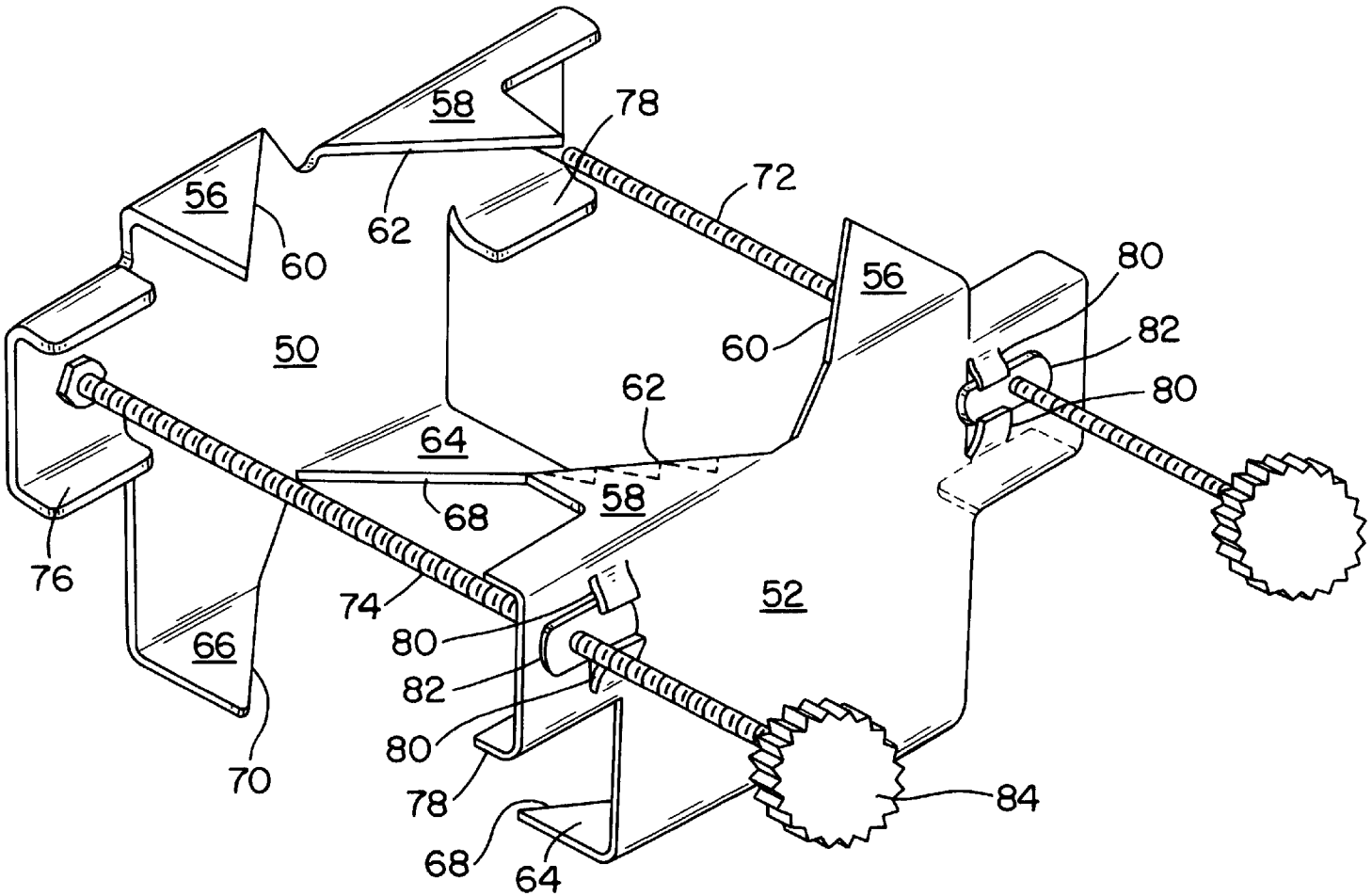
FIG. 2 is a perspective view of the clamping mechanism of the stand.

The clamping mechanism is illustrated in FIG. 2. It comprises of a pair of substantially similar steel jaws, one being a fixed jaw 50 and the other, a movable jaw 52. Each jaw has an upper pair of wedge-shaped jaw elements 56 and 58 defining clamping faces or edges 60 and 62. As indicated in chain line on jaw 62 of the movable jaw 52, the faces or edges are preferably made with a serrated form for increased gripping penetration of the tree. It will be apparent that other forms can be used.

Each jaw has a lower pair of wedge-shaped jaw elements 64 and 66 defining clamping faces or edges 68 and 70. It is to be noted that the vertical spacing between jaw elements 56 and 66 is greater than that between jaw elements 58 and 64.

A pair of ears 76 and 78 are pressed from the jaws and, as can be seen from FIG. 3, these support the clamping mechanism on the shoulders molded in the interior of the reservoir.

The clamping force is provided by a pair of bolts 72 and 74. The bolts are passed freely through holes in the fixed jaw 50 so the bolt heads bear on the back surface of that jaw. Two pairs of barbs 80 are pressed from the movable jaw and within each, there is a nut 82 with which the bolts are engaged. The barbs 80 serve to prevent rotation of the nuts but are provided with a loose fit to permit the jaws to move with some "slop" to accommodate irregularities in the trees to be clamped. Turning knobs 84 are fixed to the bolts. Assuming the use of right-hand threads, it will be apparent that counterclockwise rotation (as viewed in FIG. 2) will close the moving jaw to advance towards the fixed jaw to exert a clamping force on a tree located between them and clockwise movement will move the jaws apart. The clamping structure is placed in the reservoir with the ears 76 and 78 supporting it on shoulders 24 of the reservoir. The bolts 72 and 74 are accommodated in the recesses 45 of the reservoir.

It will be recognized the base structure is very stable and can be easily demounted for storage by flexing the latches to remove the legs. It is also to be appreciated that a tree will be gripped at eight locations which are circumferentially and vertically spaced so that it is very firmly clamped. The clamping is achieved using only two bolts as opposed to prior art arrangements using multiple thumb screws. It is to be appreciated that the stand will accommodate trees of a wide range of diameters and of significantly irregular shapes.

It is to be recognized that the clamping force is not transmitted to the base but is extended and borne by the clamping mechanism itself. This permits the use of a base which need not sustain those forces. This is in contrast to the prior art arrangements discussed above where the base/reservoir is an integral part of the clamping mechanism.

What is claimed is:

1. A tree stand comprises:

a base and a clamping mechanism secured to said base, said clamping mechanism further comprising:

a pair of opposed jaws, each having a pair of convergent clamping faces to clamp a tree at circumferentially and longitudinally spaced locations, and a drive mechanism for moving said jaws toward and away from one another to clamp and release said tree, the clamping faces on one of said opposed laws being offset longitudinally from adjacent clamping faces on the other of said opposed laws to permit said adjacent clamping faces to overlap upon movement of said opposed jaws toward one another.

2. A stand as claimed in claim 1 wherein each jaw comprises two pairs of clamping faces.

3. A tree stand according to claim 1, further comprising vertical adjusters located up on said leg assembly for adjusting an angle of said tree about said vertical axis.

4. A tree stand according to claim 2, wherein each of said opposed jaws includes two pairs of jaw elements, each of said jaw elements has one of said clamping faces associated therewith, a pair of said jaw elements on one of said opposed jaws being longitudinally spaced a distance less than a longitudinal spacing of an adjacent pair of jaw elements on the other of said opposed jaws, said opposed jaws being disposed relative to one another to permit said jaw elements on said one jaw to be accommodated within the jaw elements of said other jaw.

5. A tree stand according to claim 4, wherein said opposed jaws are constrained to slide relative to one another in direction approximately transverse to a longitudinal axis of said tree.

6. A tree stand according to claim 4, wherein said clamping faces are serrated.

7. A tree stand according to claim 5, wherein said drive mechanism includes a pair of threaded members for moving said pair of jaw elements towards one another.

8. A tree stand according to claim 7, wherein said pair of threaded members are located in holes contained in said pair of jaw elements, a diameter of said holes is larger than the diameter of said pair of threaded members for facilitating pivoting of said pair of jaw elements.

9. A tree stand according to claim 8, wherein said clamping mechanism permits pivoting of said jaw elements about both a horizontal axis and a vertical axis for providing clamping of said trunk at the circumferentially and longitudinally spaced locations.

10. A tree stand according to claim 7, wherein said pair of threaded members are located in a pair of corresponding recesses of said base.

11. A tree stand according to claim 1, wherein said base includes a leg assembly coupled to said base by a flange and complementary slot arrangement.

12. A tree stand according to claim 7, further comprising a float mechanism coupled to a water reservoir of said base for monitoring water levels therein.

* * * * *